US007690373B2

(12) United States Patent
Telford et al.

(10) Patent No.: US 7,690,373 B2
(45) Date of Patent: Apr. 6, 2010

(54) PAINTBALL GUN WITH READILY-REMOVABLE PNEUMATIC ASSEMBLY

(75) Inventors: Edward S. Telford, Greensburg, PA (US); Danial S. Jones, Ligonier, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 0 days.

(21) Appl. No.: 12/028,618

(22) Filed: Feb. 8, 2008

(65) Prior Publication Data

US 2009/0199831 A1 Aug. 13, 2009

(51) Int. Cl.
*F41B 11/00* (2006.01)

(52) U.S. Cl. ..... 124/74

(58) Field of Classification Search ..... 124/71–77; 42/77

See application file for complete search history.

(56) References Cited

U.S. PATENT DOCUMENTS

| | | | | | |
|---|---|---|---|---|---|
| 1,292,665 | A * | 1/1919 | Udesen | 124/73 |
| 1,337,967 | A * | 4/1920 | Schoen | 124/7 |
| 2,306,668 | A * | 12/1942 | Stevens | 124/67 |
| 2,450,029 | A * | 9/1948 | Wells | 124/69 |
| 3,233,601 | A * | 2/1966 | Walther | 124/69 |
| 4,103,587 | A * | 8/1978 | Vanek | 89/175 |
| 4,648,192 | A * | 3/1987 | Harness | 42/77 |
| 4,684,192 | A * | 8/1987 | Long et al. | 439/374 |
| 6,860,258 | B2 * | 3/2005 | Farrell | 124/51.1 |
| 7,395,819 | B2 * | 7/2008 | Dobbins et al. | 124/71 |
| 2002/0139362 | A1 * | 10/2002 | Shipachev et al. | 124/74 |
| 2006/0107937 | A1 * | 5/2006 | Rice | 124/73 |

* cited by examiner

*Primary Examiner*—Michael Carone
*Assistant Examiner*—Reginald Tillman, Jr.
(74) *Attorney, Agent, or Firm*—Simple IP Law, P.C.; Craig R. Rogers

(57) ABSTRACT

A paintball gun having a quick-removal assembly for readily removing a pneumatic assembly from a chamber of the paintball gun body preferably includes a lift cap hingedly connected to an end of the pneumatic mechanism. A lift pin is preferably connected to the lift cap and removably engaged within a pin receptacle of the paintball gun body. Lifting of the lift cap preferably withdraws the lift pin from the pin receptacle and enables the pneumatic assembly to be removed from the paintball gun. A self-venting mechanism can also be provided to safely release compressed gas stored in the pneumatic assembly from the paintball gun during removal of the pneumatic assembly. A latching mechanism can latch the lift cap in a forward and closed position until a user desires to remove the assembly from the paintball gun. Slots can be arranged in the lift cap to permit rearward movement of the lift cap and to cause the lift cap to move away from a body of the paintball gun to allow rotational movement of the lift cap about a hinged axis.

13 Claims, 7 Drawing Sheets

PAINTBALL GUN WITH READILY-REMOVABLE PNEUMATIC ASSEMBLY

FIELD OF THE INVENTION

The present invention relates to mechanisms and methods for removing pneumatic components from a paintball gun. In particular, this invention relates to a method and mechanism for quickly removing a pneumatic component from a paintball gun.

BACKGROUND OF THE INVENTION

Modern paintball guns are generally capable of operating at high rates of fire. At high rates of fire, even when electronic sensors and other sophisticated equipment are used to prevent ball breaks in the breech of the paintball gun, ball breaks may occasionally occur. The internal paintball gun chambers and components may also need routine maintenance and/or lubrication. When a ball breaks in the breech of the paintball gun, or when other cleaning or servicing of the internal pneumatic components needs to take place, a bolt and/or other pneumatic components of the paintball gun must generally be removed to gain access to the breech and the internal pneumatic components of the paintball gun. Although quick-removal bolt assemblies, such as that shown in U.S. Pat. No. 7,237,544, have been provided for a number of years for stacked-tube design paintball guns, quick removal solutions for single-bore or spool-valve designs have been more complicated to provide. Although some prior art solutions provide a rearwardly removable pneumatic assembly in a spool-valve design, these mechanisms generally require that the pneumatic assembly be unthreaded from the paintball gun bore after the gun has been degassed and may therefore have a more complicated removal process than desirable.

SUMMARY OF THE INVENTION

The industry would be benefited by a quick-removal pneumatic assembly for a single-bore or spool-valve style paintball gun that does not require unthreading of the internal assembly from the body. It would also be beneficial to provide a safe self-degassing mechanism to safely release any retained compressed gas during removal of the pneumatic assembly without the need for a separate degassing operation.

According to principles of the present invention, a quick-removal mechanism is provided to an end of a pneumatic assembly. The quick removal system preferably includes a lift cap and a locking pin. The lift cap can include a lift member and a tail cover. The locking pin preferably mates within a receptacle on the paintball gun body to hold the pneumatic assembly securely in place during operation of the paintball gun. The locking pin is preferably further attached to the lift cap so that an upward pull on an end of the lift cap releases the locking pin from its engagement with the paintball gun body. The quick-removal mechanism is preferably attached to a pneumatic assembly of the paintball gun arranged in a longitudinal chamber or bore of the paintball gun. When the locking pin is released from engagement with the paintball gun body, the quick-removal mechanism and attached pneumatic assembly can be removed from the paintball gun through a rearward opening in the longitudinal chamber.

The lift cap can comprise a hinged mechanism such that the lift cap is enabled to rotate upwards and downward about a hinged axis. The lift cap can further be enabled to slide forward and rearward between a latched and an unlatched position. A latching mechanism, such as a tab and detent or other latching mechanism, can be provided to latch the lift cap in a downward and forward position until removal of the internal assembly is desired and initiated by a user. The latching mechanism may, for example, include a recess arranged in the rearward end of the pneumatic assembly that matingly receives a protrusion of the lift cap, or vice versa.

Slots can be arranged in the lift cap near the rearward end of the pneumatic assembly to receive a pin that extends through the pneumatic assembly to provide the hinged axis of the lift cap. These slots can provide for adjustment of the position of the hinged axis of the lift cap. The slots can, for instance, be arcuate, linear, or in a ramping step-like shape. As the lift cap is moved rearward, the slots preferably guide the lift cap slightly upward away from the paintball gun body to provide clearance between a bottom edge of the tail cover and the paintball gun body to permit pivoting of the lift cap.

A longitudinal slot can also be provided in the lift cap to receive a connecting pin of the locking pin. The connecting pin is preferably arranged through an upper end of the locking pin and within the longitudinal slot of the lift cap. The slot enables the lift cap to be moved forwards and rearwards with the locking pin still partially engaged in the receptacle of the paintball gun body. As the lift cap is rotated upwards, the connecting pin allows the lift cap to pivot with respect to the locking pin while the locking pin is moved upwards out of engagement with the receptacle in the paintball gun body.

According to another aspect of the present invention, a venting system can be arranged in the quick-release mechanism to safely vent any compressed gas stored in the paintball gun when the lift cap is lifted. In one embodiment, for instance, this can include a plurality of sealing members arranged on the locking pin and one or more vent channels arranged in the pneumatic assembly. When the locking pin is secured within the receptacle in the paintball gun, the sealing members preferably prevent the escape of compressed gas from the vent channel. However, as the locking pin is retracted from the pin receptacle, the sealing members are preferably also moved to permit compressed gas to escape from the vent channels and safely exit the paintball gun body. In this manner, the paintball gun can be configured to automatically self-degas (or depressurize) during removal of the pneumatic assembly, without the need for a previous degassing operation.

A method of removing a pneumatic assembly from a chamber of a paintball gun according to additional principles of the present invention preferably proceeds by lifting a lift cap of a quick-removal mechanism to release a pin from engagement with a pin receptacle in the paintball gun. The lift cap is preferably connected to the pneumatic assembly, and the lift cap and the pneumatic assembly can then be extracted from the paintball gun through a rearward opening in the chamber. The method may further include self-degassing the paintball gun during removal of the pneumatic assembly.

BRIEF DESCRIPTION OF THE DRAWINGS

The foregoing and additional objects features, and advantages of the present invention will become more readily apparent from the following detailed description, made with reference to the accompanying figures, in which.

DETAILED DESCRIPTION

Figure 1A:
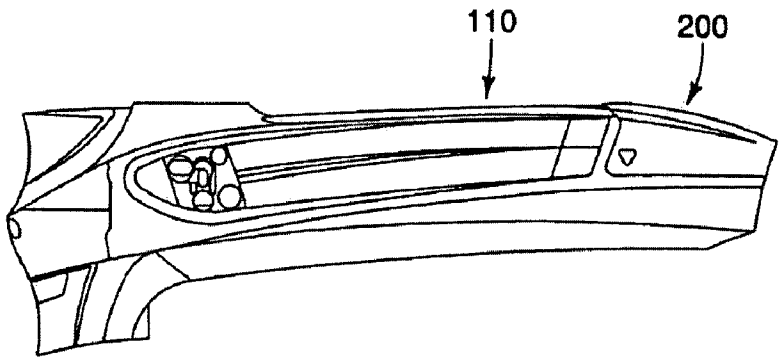
FIG. 1A is a somewhat schematic side view of a paintball gun body enabling quick removal of an internal pneumatic assembly according to principles of the present invention, shown with the internal pneumatic assembly arranged in the paintball gun and a lift cap of the quick-removal assembly arranged in a latched position.
Figure 1B:
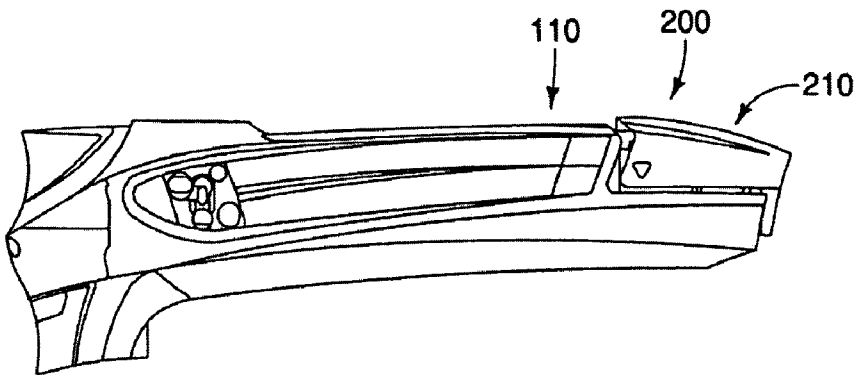
FIG. 1B is a somewhat schematic side view of the paintball gun of FIG. 1A, where the lift cap has been moved rearward and unlatched from the paintball gun body.
Figure 1C:
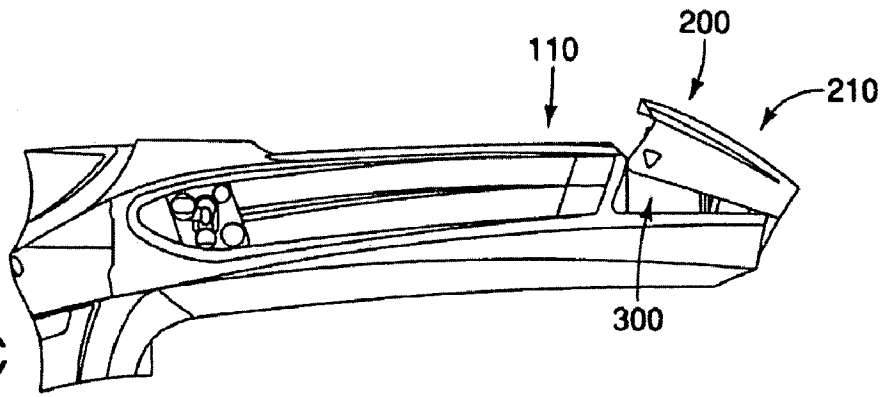
FIG. 1C is a somewhat schematic side view of the paintball gun of FIGS. 1A and 1B, where the lift cap has been moved rearward, unlatched from the paintball gun body, and lifted to release a locking pin from engagement with the paintball gun.
Figures 2A, 2B, 2C:
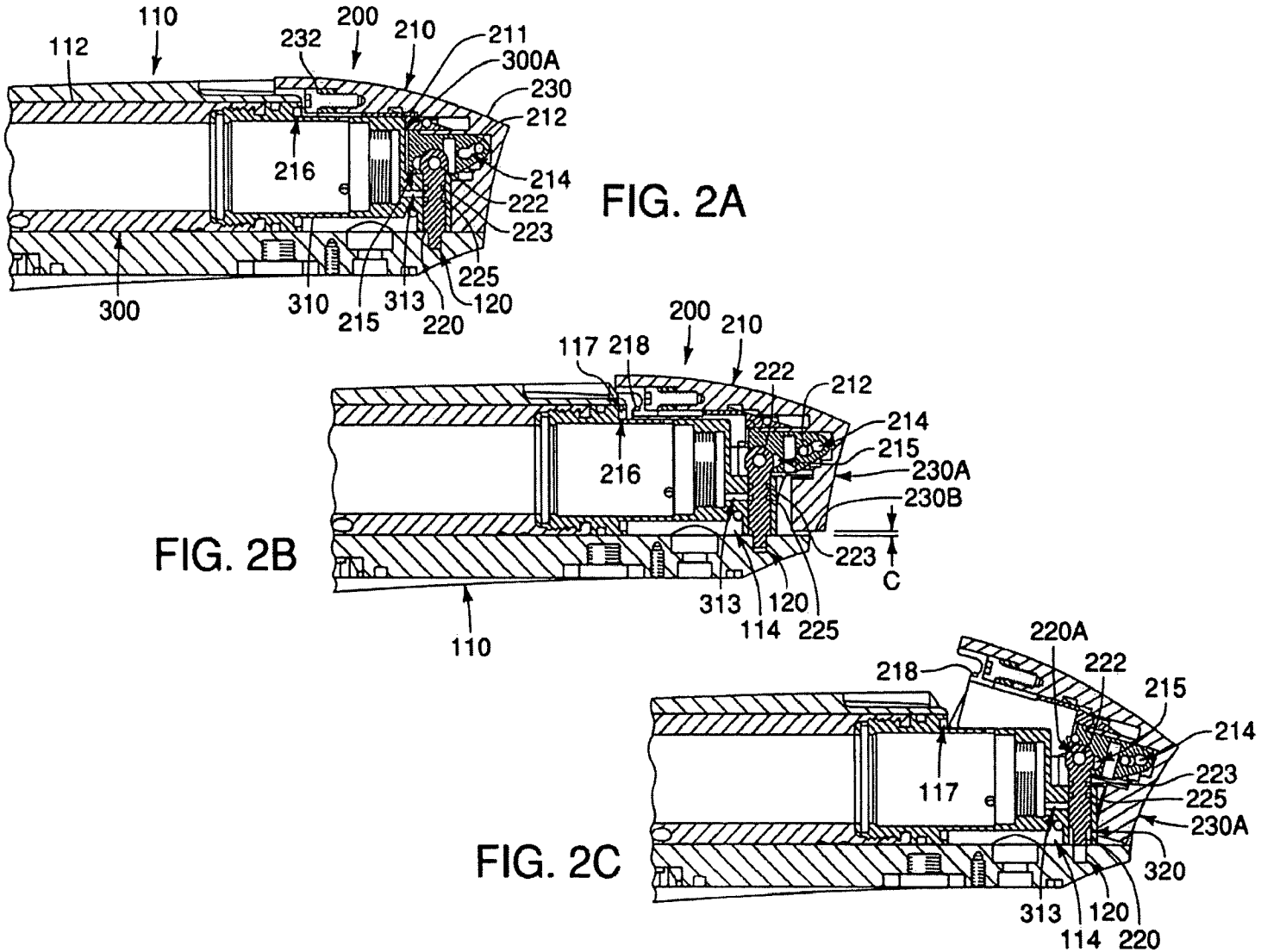
FIG. 2A is a somewhat schematic cross-sectional side view of the paintball gin body and quick-release mechanism of FIG. 1A, illustrating internal components thereof.
FIG. 2B is a somewhat schematic cross-sectional side view of the paintball gun body and quick-release mechanism of FIG. 1B, illustrating internal components thereof.
FIG. 2C is a somewhat schematic cross-sectional side view of the paintball gun body and quick-release mechanism of FIG. 1C, illustrating internal components thereof.
Figure 3B:
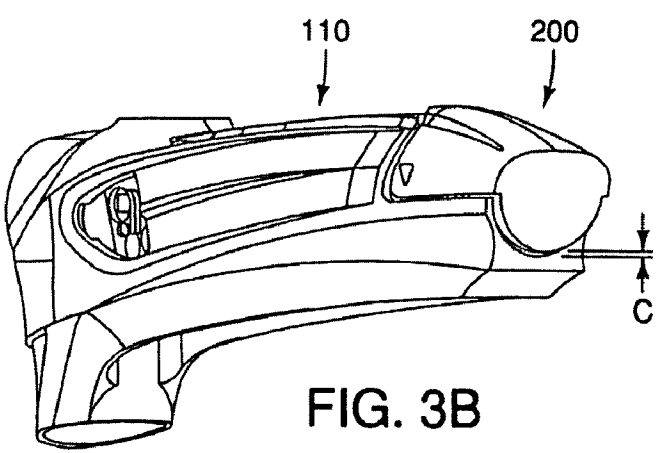
FIG. 3B is a somewhat schematic perspective view of the paintball gun body and quick-release mechanism of FIG. 1B, taken from the rearward end of the paintball gun.
Figure 3A:
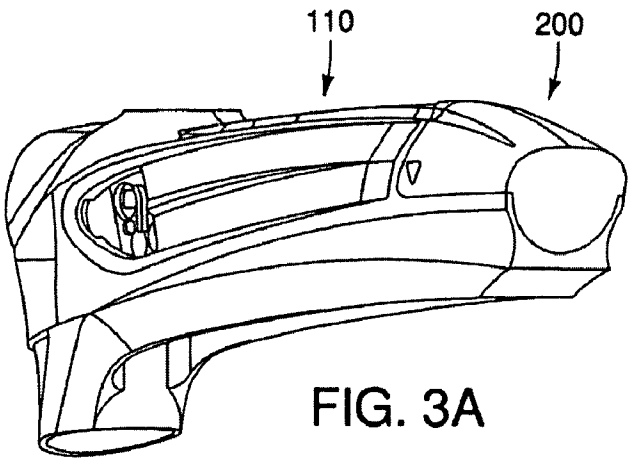
FIG. 3A is a somewhat schematic perspective view of the paintball gun body and quick-release mechanism of FIG. 1A, taken from the rearward end of the paintball gun.
Figure 3C:
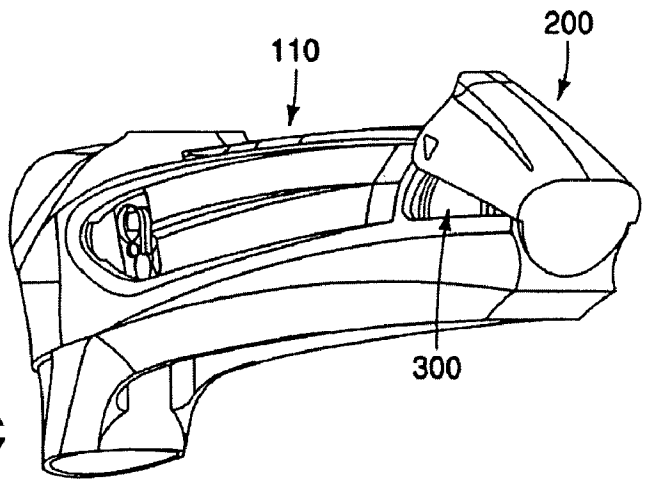
FIG. 3C is a somewhat schematic perspective view of the paintball gun body and quick-release mechanism of FIG. 1C, taken from the rearward end of-the paintball gun.
Figure 4A:
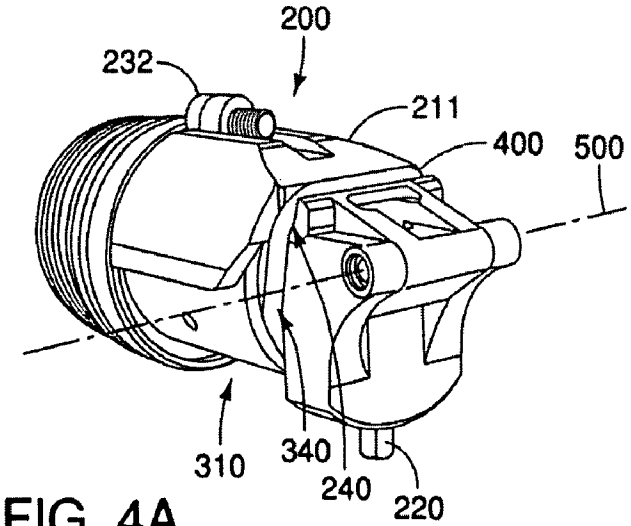
FIG. 4A is a somewhat schematic perspective view of the lift cap and locking pin of the quick-release mechanism and the end cap of the pneumatic assembly of FIG. 2A, shown removed from the paintball gun body and without the external tail cover.
Figure 4B:
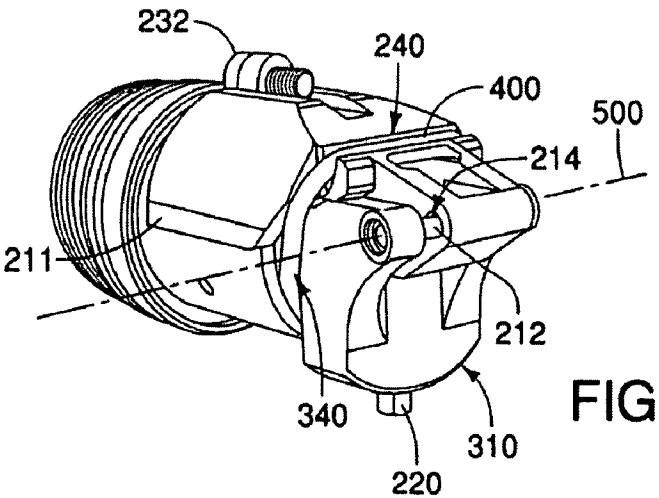
FIG. 4B is a somewhat schematic perspective view of the lift cap and locking pin of the quick-release mechanism and the end cap of the pneumatic assembly of FIG. 2B, shown removed from the paintball gun body and without the external tail cover.
Figure 4C:
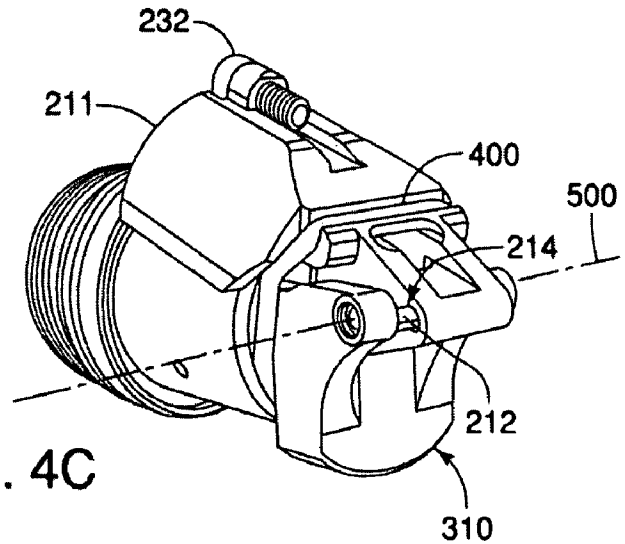
FIG. 4C is a somewhat schematic perspective view of the lift cap and locking pin of the quick-release mechanism and the end cap of the pneumatic assembly of FIG. 2C, shown removed from the paintball gun body and without the external tail cover.
Figure 6:
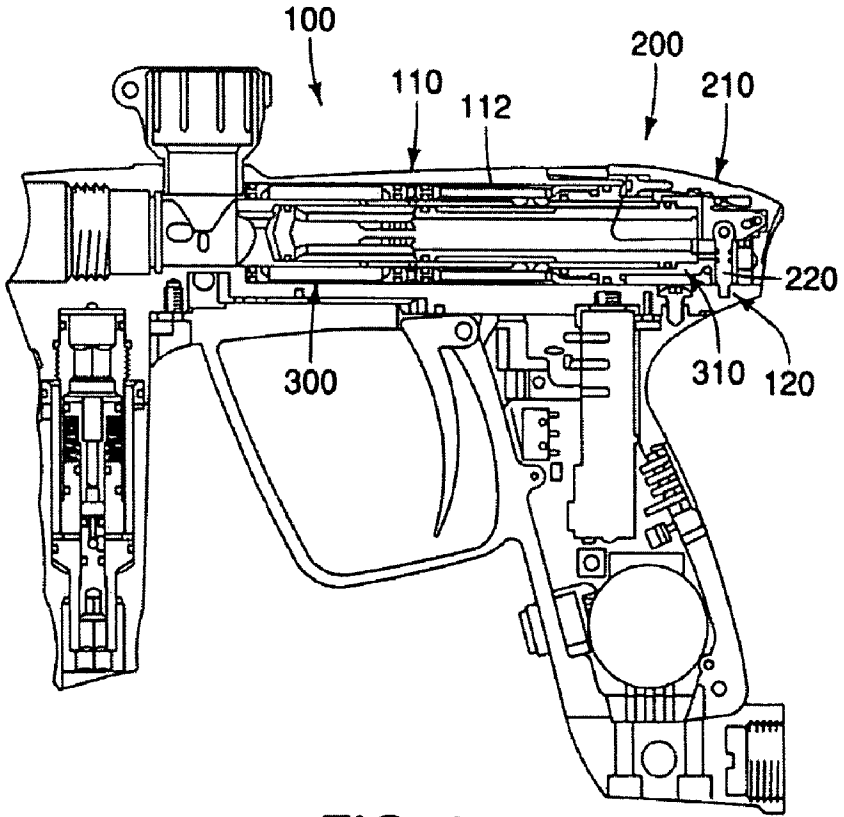
FIG. 6 is a somewhat schematic cross-sectional side view of the paintball gun of FIG. 5.
Figure 5:
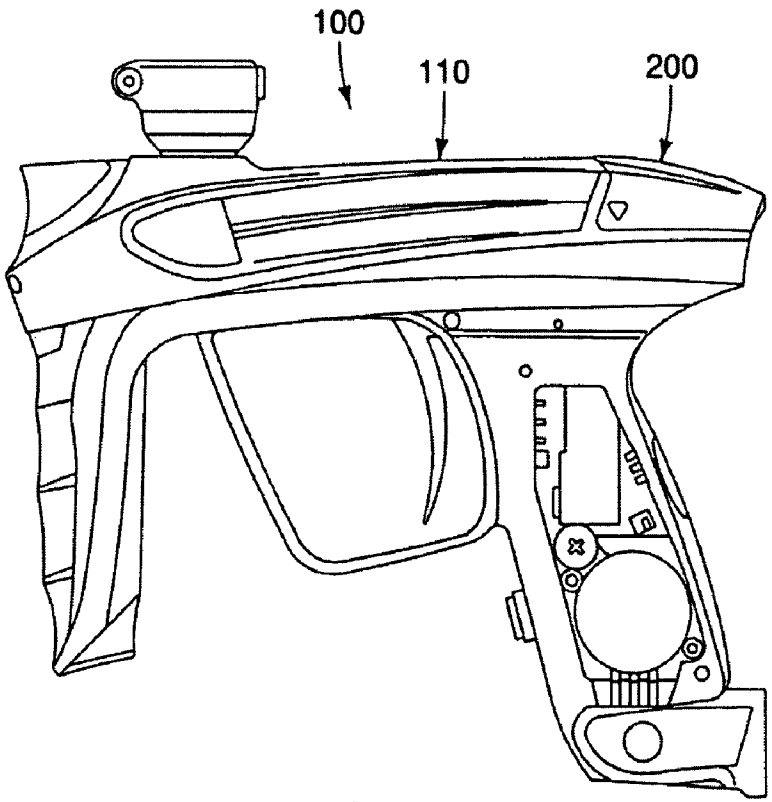
FIG. 5 is a somewhat schematic side view of a paintball gun constructed having a paintball gun body with a readily-removable pneumatic assembly according to principles of the present invention.
Figure 7:
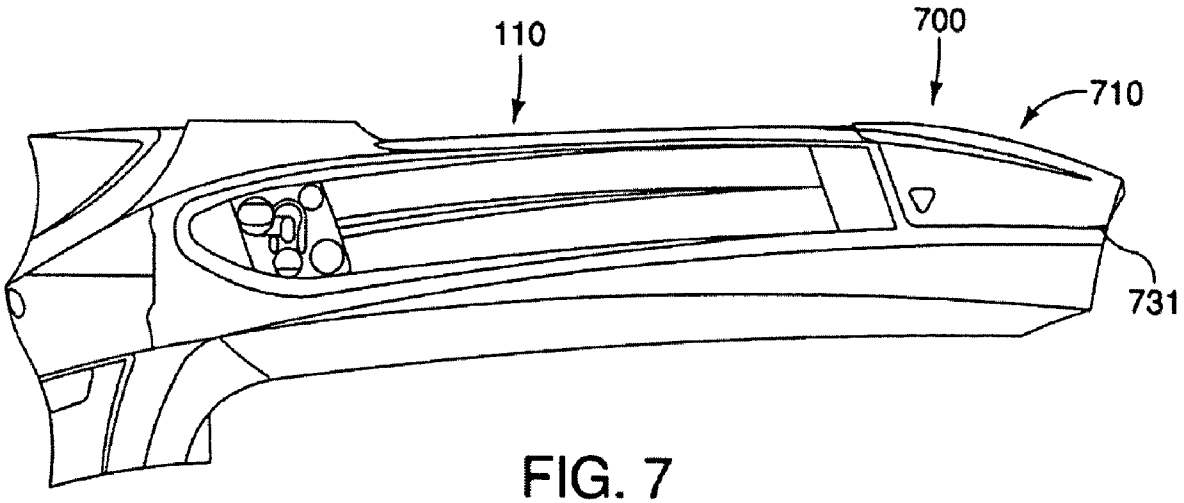
FIGS. 7 and 8 are somewhat schematic side views of a paintball gun body and quick-release mechanism according to an alternate embodiment incorporating principles of the present invention, showing the lift cap in a closed and open position respectively.
Figure 8:
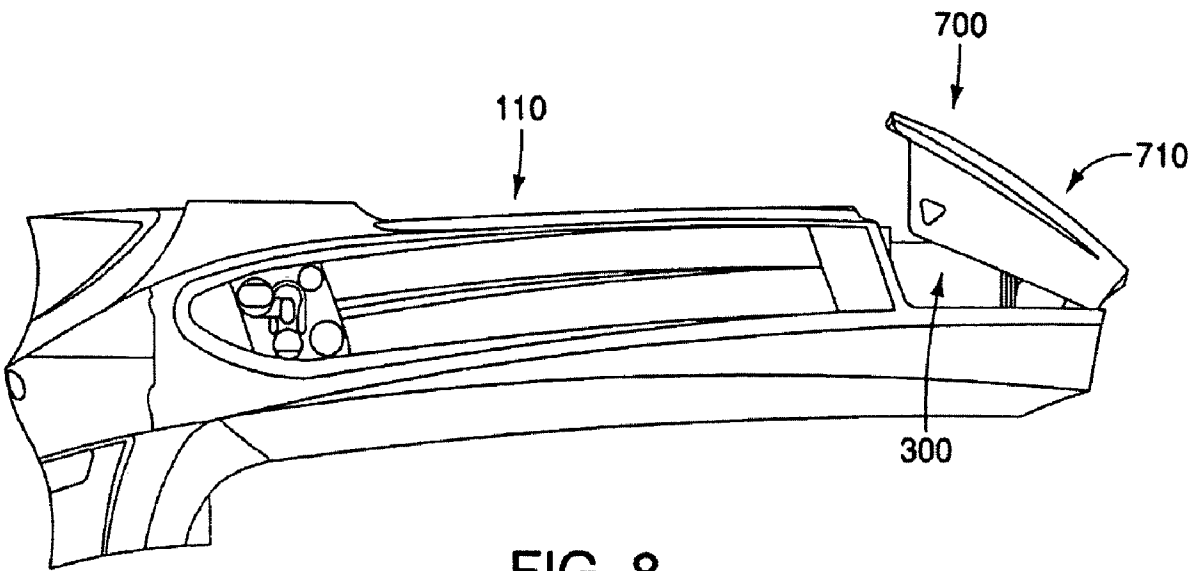
Figure 9:
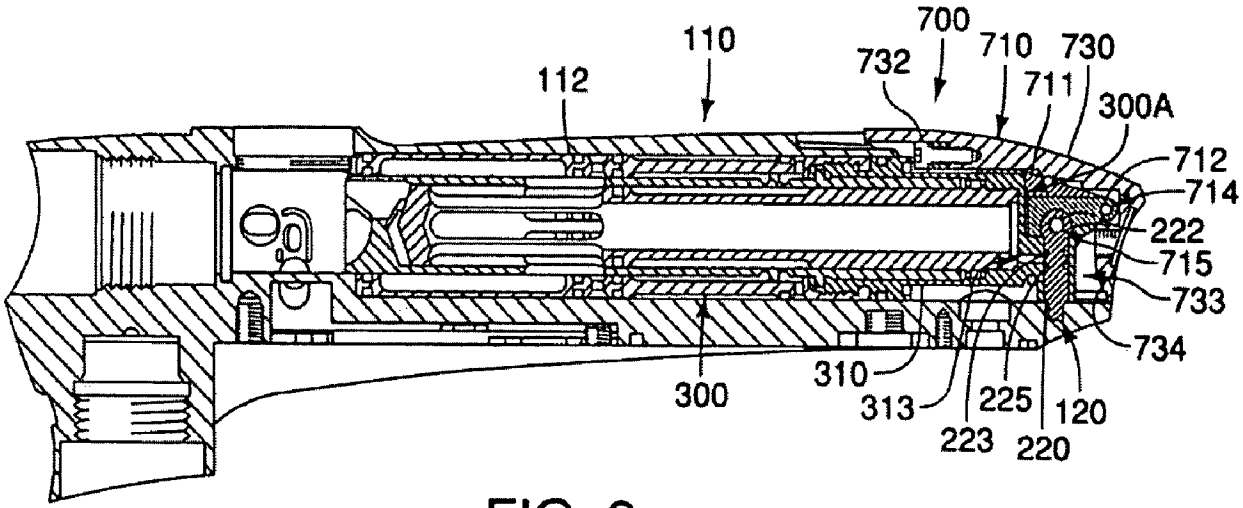
FIGS. 9 and 10 are somewhat schematic cross-sectional side views of the quick-release mechanism of FIGS. 7 and 8.
Figure 10:
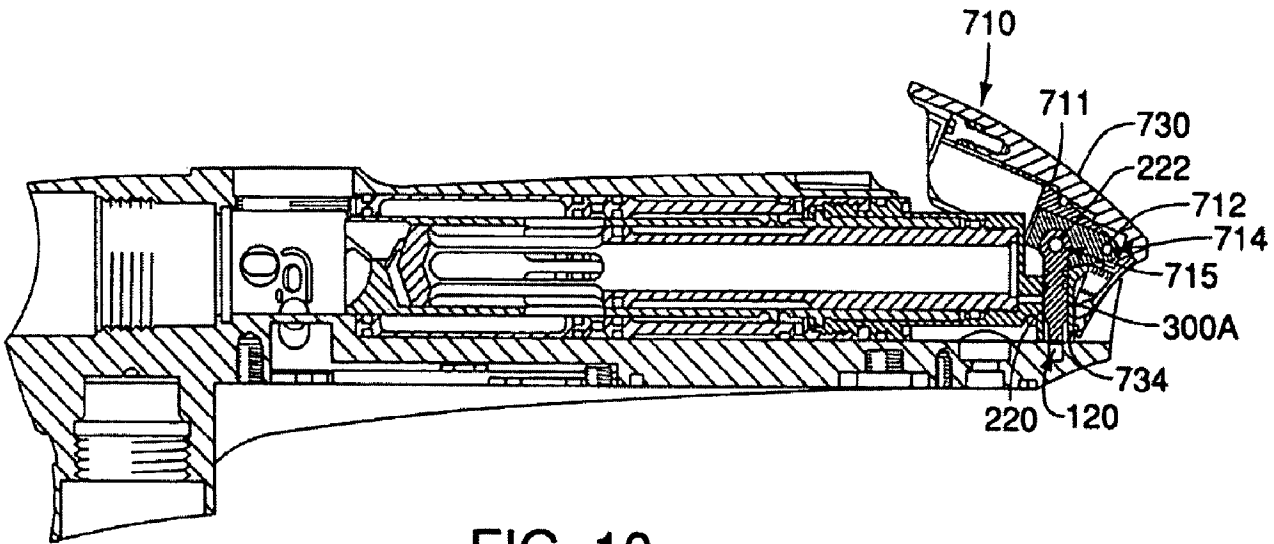

In the following detailed description, reference is made to the accompanying drawings, which form part thereof and in which are shown by way of illustration exemplary non-limiting embodiments illustrating various principles of the present invention and how it may be practiced. In the drawings, FIGS. 1A-1C are somewhat schematic side views illustrating operation of a quick-removal assembly 200 that enables quick removal of an internal pneumatic assembly 300 from an chamber of a paintball gun body 110 according to principles of the present invention. FIGS. 2A-2C are somewhat schematic cross-sectional side views of the paintball gun body 110 and quick-removal assembly 200 of FIGS. 1A-1C. FIGS. 3A-3C are somewhat schematic perspective views of a rearward end of the paintball gun body 110 during the various stages of operation of the quick-removal assembly 200 depicted in FIGS. 1A-1C. And FIGS. 4A-4C are somewhat schematic perspective views illustrating an end cap 310 of the pneumatic assembly 300 and various internal components of the quick-removal assembly 200 during the different phases of removal depicted in FIGS. 1A-1C. FIGS. 5 and 6 are a side view and a cross-sectional side view, respectively, of a paintball gun 100 incorporating the quick-removal assembly 200.

Referring first to FIGS. 1A, 2A, 3A, 4A, 5, and 6, during operation of a paintball gun 100, the pneumatic assembly 300 and quick-removal assembly 200 are arranged in the paintball gun body 110. More specifically, the internal pneumatic assembly 300 is preferably arranged in a longitudinal chamber 112 of the paintball gun body 110 and a lift cap 210 of the quick-removal assembly 200 is arranged in a latched position at the rearward end of the bore 112.

The lift cap 210 of the quick-removal mechanism 200 is preferably attached to a rearwardly-arranged end cap 310 of a pneumatic assembly 300. The end cap 310 can be connected to the remainder of the pneumatic assembly through a threaded or other connection. The quick-removal system 200 preferably includes a lift cap 210 and a locking pin 220. The lift cap 210 can include a lift member 211 connected to a tail cover 230 by a cover screw 232. The lift cap is preferably hingedly attached to the end cap 310 via a hinge pin 212 providing a hinged axis 500. The locking (or lift) pin 220 preferably slides vertically within a channel 320 in the end cap and mates within a receptacle 120 in the paintball gun body 110 to hold the pneumatic assembly 300 securely in place during operation of the paintball gun 100. The locking pin 220 is preferably further attached to the lift cap 210 so that an upward pull on the lift cap 210 releases the locking pin 220 from its engagement with the paintball gun body 110. When the locking pin 220 is released from engagement with the paintball gun body 110, the quick-removal mechanism 200 and attached pneumatic assembly 300 can be removed from the paintball gun 100 through a rearward opening 114 in the longitudinal chamber 112.

A latching mechanism 216, such as a tab and detent or other latching mechanism, can be provided to latch the lift cap 210 in a downward and forward position with respect to the paintball gun body 110 until removal of the internal pneumatic assembly 300 is desired and initiated by a user. The latching mechanism may, for example, include a recess 117 arranged in the rearward end of the pneumatic assembly 300 that matingly receives a protrusion 218 from the lift member 211. The latching mechanism can also (or alternatively) be provided by a recess and protrusion arranged in the opposite members, or be provided by other components entirely.

Referring now to FIGS. 1B, 2B, 3B, and 4B, as explained previously, the quick-removal mechanism 200 is preferably attached to the pneumatic assembly 300, which is arranged in the longitudinal chamber 112 of the paintball gun 100. The lift cap 210 can comprise a hinged mechanism such that the lift cap 210 is enabled to rotate upwards to a released position (see, e.g., FIG. 1C) and downward to an engaged position (see, e.g., FIG. 1A) about a hinge axis. The hinged axis 500 can be provided, for instance, by a pivot pin 212 arranged through one or more pivot slots 214. As the lift cap 210 is moved rearward, the latching mechanism is preferably unlatched to enable the forward end of the lift cap 210 to be lifted upward.

Slots 214, arranged in the lift cap 210 near the rearward end 300A of the pneumatic assembly 300 preferably receive a pin 212 that extends through the end cap 310 of the pneumatic assembly 300 to provide the hinged axis of the lift cap 210. These slots 214 can provide for adjustment of the position of the hinged axis 500 of the lift cap 210. In the embodiment shown, the slots 214 are arranged in a step-like ramping shape. The slots can alternatively, however, be arcuate or in a slanted line shape, for example. As the lift cap 210 is moved rearward, the slots 214 preferably guide the lift cap 210 slightly upward away from the paintball gun body 110 to provide clearance "C" between a bottom edge 230B of the rearward end 230A of the lift cap or tail cover 230 and the paintball gun body 110 to permit pivoting of the lift cap 210.

A longitudinal slot 215 can also be provided in the lift member 211 of the lift cap 210 to receive a connecting pivot pin 222 of the locking lift pin 220. The connecting pin 222 is preferably arranged through an upper end 220A of the lift pin 220 and within the longitudinal slot 215 of the lift cap 210. The slot 215 enables the lift cap 210 to be moved forwards and rearwards with the lift pin 220 still at least partially engaged in the receptacle 120 of the paintball gun body 110.

Referring now additionally to FIGS. 1C, 2C, 3C, and 4C, as the lift cap 210 is rotated upwards about its hinged axis, the connecting pin 222 allows the lift cap 210 to pivot with respect to the locking pin 220 and the locking pin 220 is moved upwards out of engagement with the receptacle 120 in the paintball gun body 110. Once the locking pin 220 is removed from engagement with the receptacle 120 of the paintball gun body 110, the lilt cap 210 and the connected pneumatic assembly 300 can be extracted from the paintball gun 100 through the rearward opening in the longitudinal chamber 112.

Referring back to FIGS. 2A-2C, according to another aspect of the present invention, a venting system can be arranged in the quick-release mechanism 200 to safely vent any compressed gas stored in the pneumatic assembly 300 of the paintball gun 100 when the lift cap 210 is lifted. In the embodiment depicted, for instance, this can include a plurality of sealing members 223, 225 arranged on the locking pin 220 and one or more vent channels 313 arranged through a rearward end of the end cap 310 of the pneumatic assembly 300. When the locking pin 220 is secured within the receptacle 120 in the paintball gun 100, the sealing members 223, 225 are preferably arranged on opposite sides of the vent channel 313 to prevent the escape of compressed gas from the vent channel 313. However, as the locking pin 220 is retracted from the pin receptacle 120, the sealing members 223, 225 are preferably also moved upward such that the lower sealing member 225 slides across the opening to the vent channel 313 to permit compressed gas to escape from the vent channel 313 and safely exit the paintball gun 100. The gas can, for example, be vented from the paintball gun 100 through an exhaust port in the paintball gun body 110 or out the rearward end of the paintball gun body 110. In this manner, the paintball gun 100 can be configured to automatically self-degas during removal of the pneumatic assembly 300 without the need for a previous degassing.

Referring specifically to FIGS. 4A-4C, a biasing member 400, such as an elastic band or o-ring, is also preferably provided to bias the lift cap 210 (see FIG. 2A) in its forward and closed position. More particularly, the biasing member 400 is preferably connected between the end cap 310 of the pneumatic assembly 300 and the lift member 211 of the lift cap 210 to bias the lift cap 210 against the end cap 310 in its forward and closed position.

In the case of an o-ring or other elastic band, for instance, slots or grooves 240, 340 can be provided in the lift member 211 of the lift cap 210 and the end cap 310, respectively, to retain the o-ring or band 400 in position. As the lift member 211 is moved rearwards and upwards away from end cap 310, the o-ring 400 is stretched, creating a biasing force that urges the lift member 211 back towards its original position with respect to the end cap 310. This biasing force also helps retain the lift pin 220 engaged within the pin receptacle 120 of the paintball gun when the pneumatic assembly 300 and quick-removal assembly 200 are installed in the paintball gun chamber 112.

Referring to FIGS. 1A-6, a method of removing a pneumatic assembly 300 from a chamber 112 of a paintball gun 100 preferably proceeds by lifting a lift cap 210 of a quick-removal mechanism 200 to release a pin 220 from engagement with a pin receptacle 120 in the paintball gun 100. The lift cap 210 is preferably connected to the pneumatic assembly 300, and the lift cap 210 and the pneumatic assembly 300 can then be extracted from the paintball gun 100 through a rearward opening in the chamber 112. The method may further include self-degassing the paintball gun 100 during removal of the pneumatic assembly 300.

Referring now to FIGS. 7-10, in an alternative embodiment according to further principles of the present invention, the quick-releasing mechanism 700 is configured to rotate upwards with respect to the paintball gun body 110, without first sliding rearward. This embodiment is constructed similar to the previously-described quick-releasing mechanism 200, except that the connecting pivot pin 222 is arranged in a shorter slot 715 as compared to the slot 215 (see FIGS. 2A-2C) to restrict the movement of the connecting pivot pin 222 with respect to the lift cap 710. The pin 712 is also received in a pin hole 714 rather than a slot 214. In this case, sliding movement of the lift cap 710 with respect to the locking pin 220 and of the pin 712 with respect to the pneumatic assembly 300 are both prevented, while rotational movement of the lift cap 710 with respect to the locking pin 220 and the pneumatic assembly 300 is still enabled.

In addition, a cavity 733, arranged in the lift cap 710, permits rotation of the lift cap 710 with respect to the locking pin 220 by preventing interference between the lift member 711 and the end cap 310 during rotational movement of the lift cap 710. An angled surface 734 on the inside of the tail cover 730 provides a stop for preventing excess rotation of the lift cap 710 by abutting against the rearward end 300A of the pneumatic mechanism 300 when the lift cap 710 is fully lifted. An arcuate corner 731 is also preferably provided on the lower, rearward edges of the lift cap 710 to enable upward rotation of the forward end of the lift cap 710 with respect to the paintball gun body 110. The latching mechanism 216 for holding the lift cap 210 of the previous embodiment 200 in its downward and forward position can also be eliminated from this embodiment 700.

Having described and illustrated principles of the present invention in various preferred embodiments thereof, it should be apparent that the invention can be modified in arrangement and detail without departing from such principles. Furthermore, in the described method, one or more of the steps can be combined with other steps, separated into additional steps, rearranged with other steps, or omitted altogether. We therefore claim all modifications and variations coming within the spirit and scope of the following claims.

What is claimed is:

1. A pneumatic gun, comprising:

a chamber receiving a pneumatic assembly, the pneumatic assembly comprising a compressed gas storage chamber and a bolt; and a quick-removal mechanism connected to the pneumatic assembly, wherein the quick-removal mechanism comprises a lift cap connected to a lift pin, and wherein movement of the lift cap releases the lift pin from engagement in a receptacle of the pneumatic gun to enable removal of the pneumatic assembly from the pneumatic gun and wherein the lift pin remains connected to the pneumatic assembly during removal from the pneumatic gun.

2. A pneumatic gun according to claim 1, wherein the lift cap is hingedly connected to the pneumatic assembly to enable rotation about a hinged axis.

3. A pneumatic gun according to claim 2, wherein the lift pin is hingedly connected to the lift cap to enable rotation of the lift pin about a pin axis.

4. A pneumatic gun according to claim according to claim 3, wherein movement of the lift cap to release the lift pin from engagement in the pin receptacle is an upward rotation about the hinged axis between the lift cap and the pneumatic assembly.

5. A pneumatic gun according to claim 2, further comprising a slot arranged in the lift cap, wherein said slot is configured to receive a hinge pin providing the hinged axis such that the position of the hinged axis can be moved with respect to the lift cap.

6. A pneumatic gun according to claim 5, wherein the slot comprises a ramping step-like shape to cause the lift cap to move away from the pneumatic gun and provide clearance for rotational movement of the lift cap as the lift cap is moved rearward.

7. A pneumatic gun according to claim 5, wherein the slot comprises an arcuate shape to cause the lift cap to move away from the pneumatic gun and provide clearance for rotational movement of the lift cap as the lift cap is moved rearward.

8. A pneumatic gun according to claim 3, wherein the lift cap comprises a pin slot configured to receive a pin that provides the pin axis of the lift pin, and wherein the pin slot comprises a longitudinally-arranged slot that enables the lift cap to move rearwardly with the lift pin still arranged at least partially within the pin receptacle of the pneumatic gun.

9. A pneumatic gun according to claim 1, further comprising a biasing member configured to bias the lift cap in a desired position with respect to the pneumatic assembly.

10. A pneumatic gun according to claim 1, further comprising a self-venting system that vents compressed gas from the pneumatic assembly in response to lift cap movement before the pneumatic assembly is removed from the gun.

11. A pneumatic gun, comprising:

a chamber removably housing a pneumatic assembly;

a quick-release mechanism comprising a lift cap connected to an end cap of the pneumatic assembly;

a lift pin connected to the lift cap, said lift pin having an engagement end configured to matingly engage within a pin receptacle of the pneumatic gun to secure the lift cap and pneumatic assembly to the paintball gun;

a hinge pin providing a hinged axis between the lift cap and the pneumatic assembly, wherein rotational movement of the lift cap about the hinged axis causes the lift pin to disengage from the pin receptacle of the paintball gun to enable quick removal of the quick-release mechanism and pneumatic assembly from the pneumatic gun;

a biasing member configured to bias the lift cap toward a desired position with respect to the end cap of the pneumatic assembly; and wherein the end cap comprises a vent channel to exhaust compressed gas from the pneumatic assembly, and wherein the lift pin comprises a seal arranged proximal to the vent channel to prevent the release of compressed gas from the vent channel when the lift pin is in an engaged position and to enable the release of compressed gas from the vent channel when the lift pin is in a disengaged position.

12. A pneumatic gun according to claim 11, further comprising a latching mechanism to latch the lift cap in a forward and closed position when the pneumatic gun is in an operating condition.

13. A pneumatic gun, comprising:

a chamber removably housing a pneumatic assembly;

a quick-release mechanism comprising a lift cap connected to an end cap of the pneumatic assembly;

a lift pin connected to the lift cap, said lift pin having an engagement end configured to matingly engage within a pin receptacle of the pneumatic gun to secure the lift cap and pneumatic assembly to the paintball gun; and a hinge pin providing a hinged axis between the lift cap and the pneumatic assembly, wherein rotational movement of the lift cap about the hinged axis causes the lift pin to disengage from the pin receptacle of the paintball gun to enable quick removal of the quick-release mechanism and pneumatic assembly from the pneumatic gun, wherein the hinge pin is arranged in a slot, and wherein the slot is slanted to cause the quick-release mechanism to separate from the pneumatic gun as the quick-release mechanism is moved rearward.

* * * * *